US008103200B2

(12) United States Patent
Ito et al.

(10) Patent No.: US 8,103,200 B2
(45) Date of Patent: Jan. 24, 2012

(54) IMAGE FORMING APPARATUS

(75) Inventors: Takayuki Ito, Nagoya (JP); Shoichi Yoshikawa, Okazaki (JP); Fuminori Moro, Hachioji (JP); Noboru Oomoto, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 413 days.

(21) Appl. No.: 12/477,172

(22) Filed: Jun. 3, 2009

(65) Prior Publication Data

US 2009/0304416 A1 Dec. 10, 2009

(30) Foreign Application Priority Data

Jun. 10, 2008 (JP) ..... 2008-151797

(51) Int. Cl.
*G03G 15/22* (2006.01)

(52) U.S. Cl. ..... 399/298

(58) Field of Classification Search ..... 399/116, 399/117, 298, 299, 306
See application file for complete search history.

(56) References Cited

U.S. PATENT DOCUMENTS 4,371,253 A * 2/1983 Day et al. ..... 399/179
5,765,074 A 6/1998 Yasui et al.
5,765,081 A * 6/1998 Bogaert et al. ..... 399/299
6,484,008 B2 * 11/2002 Arcaro et al. ..... 399/301
2008/0166163 A1 * 7/2008 Orui et al. ..... 399/397

FOREIGN PATENT DOCUMENTS

JP 7-319254 A 12/1995
JP 9-015916 A 1/1997
JP 2006-349701 A 12/2006

* cited by examiner

*Primary Examiner* — David Gray
*Assistant Examiner* — Gregory H Curran
(74) *Attorney, Agent, or Firm* — Buchanan Ingersoll & Rooney PC

(57) ABSTRACT

An image forming apparatus includes a plurality of image carrier rollers placed on an inner circumferential side of an annular conveying path so as to face the annular conveying path and so as to be juxtaposed in a sheet conveying direction along the annular conveying path. Opposed rollers are provided on the outer circumferential side of the annular conveying path. Imaging sections for forming intrinsic color images on surfaces of the respective image carrier rollers are provided. A sheet is introduced to the annular conveying path and is conveyed along the sheet conveying direction sequentially through nip sections of the rollers, while the images formed on the surfaces of the respective image carrier rollers by the imaging sections are transferred one by one onto the sheet. The sheet with the images transferred thereon is released from the annular conveying path.

9 Claims, 6 Drawing Sheets

IMAGE FORMING APPARATUS

This application is based on an application No. 2008-151797 filed on Jun. 10, 2008 in Japan, the entire content of which is hereby incorporated by reference.

TECHNICAL FIELD

The present invention relates to an image forming apparatus, and more specifically relates to a color image forming apparatus.

BACKGROUND ART

As a color image forming apparatus, there has conventionally been known an apparatus including four pairs of photoconductor drums and rollers which are in pressure contact with the photoconductor drums (hereinafter referred to as "pairs of transfer rollers"), the pairs of transfer rollers being aligned on one row at intervals, in which recording media (hereinafter referred to as "sheets") are conveyed sequentially through nip sections of the respective pairs of transfer rollers, and toner images formed on the photoconductor drum surfaces with electrophotographic method are sequentially transferred onto the sheets (see, e.g., JP H07-319254 A).

SUMMARY OF THE INVENTION

Technical Problem

However, in the configuration of JP H07-319254 A, four pairs of transfer rollers are aligned on one row at intervals, which causes a problem of upsizing of the apparatus. Moreover, the conveying speed of each pair of transfer rollers generally varies due to various factors such as variation in diameter of rollers and deflection of rotating shafts. Accordingly, in the case where the sheets are linearly conveyed, one sheet may be pulled in different direction at the same and thereby receive excessive load. This makes it difficult to maintain conveyance stability and image quality of the sheets.

Accordingly, an object of the present invention is to provide an image forming apparatus which can achieve downsizing and which can maintain sufficient conveyance stability and image quality of the sheets.

Solution to Problem

In order to achieve the object, an image forming apparatus according to the present invention comprises:

an annular conveying path which is curved to have an annular shape;

a plurality of image carrier rollers placed on an inner circumferential side of the annular conveying path so as to face the annular conveying path and so as to be juxtaposed in a sheet conveying direction along the annular conveying path;

opposed rollers provided on an outer circumferential side of the annular conveying path so as to be in pressure contact with each of the image carrier rollers to constitute pairs of transfer rollers together with each of the image carrier rollers;

imaging sections for forming intrinsic color images on surfaces of the respective image carrier rollers; and a control section for controlling so that a sheet is introduced to the annular conveying path and is passed sequentially through nip sections of the pairs of transfer rollers so as to be conveyed along the sheet conveying direction, while images, which are formed on surfaces of the respective image carrier rollers by the imaging sections, are transferred one by one onto the sheet, and the sheet with the images transferred thereon are released from the annular conveying path.

In the image forming apparatus in the invention, the control section controls so that a sheet is introduced to the annular conveying path and is passed sequentially through nip sections of the pairs of transfer rollers so as to be conveyed along the sheet conveying direction, while images, which have been formed on surfaces of the image carrier rollers by the imaging sections, are transferred one by one onto the sheets, and the sheets with the images transferred thereon are released from the annular conveying path. Accordingly, the sheets with the images transferred from each of the image carrier rollers are obtained.

The phrase that the annular conveying path is "curved to have an annular shape" is used herein to mean that the path is neither straight nor bent but is curved to form a loop. Therefore, the shape is not limited to a perfect circle but may be, for example, an ellipse circle.

The word "intrinsic color" herein refers to the color intrinsic to a specific image carrier roller. For example, the intrinsic colors refer to fundamental colors such as yellow, cyan, magenta, and black.

In the image forming apparatus, a plurality of pairs of transfer rollers are placed so as to be juxtaposed along the sheet conveying direction in the annular conveying path. Therefore, as compared with the apparatus configured so that a plurality of pairs of transfer rollers are linearly placed on one row as in the case of JP H07-319254 A, the image forming apparatus of the invention is configured to be small. The annular conveying path is curved to have an annular shape. Therefore, even if the conveying speeds of the respective pairs of transfer rollers vary to some extent, the sheet is curved in between the pairs of transfer rollers and has enough allowance for tensile stress, so that it becomes possible to avoid excessive load from being applied onto the sheet. As a result, sufficient conveyance stability and image quality of the sheet can be maintained.

In this case, the length of the annular conveying path along the sheet conveying direction should preferably be longer than the size of the sheet with respect to the sheet conveying direction. If this is the case, the top end and the tail end of the sheet do not overlap and the paper sheet is conveyed smoothly.

BRIEF DESCRIPTION OF DRAWINGS

The present invention will become more fully understood from the detailed description given hereinbelow and the accompanying drawings which are given by way of illustration only, and thus are not limitative of the present invention, and wherein.

DESCRIPTION OF EMBODIMENTS

Hereinbelow, the present invention will be described in detail in conjunction with the embodiments with reference to the drawings.

First Embodiment

Figure 1:
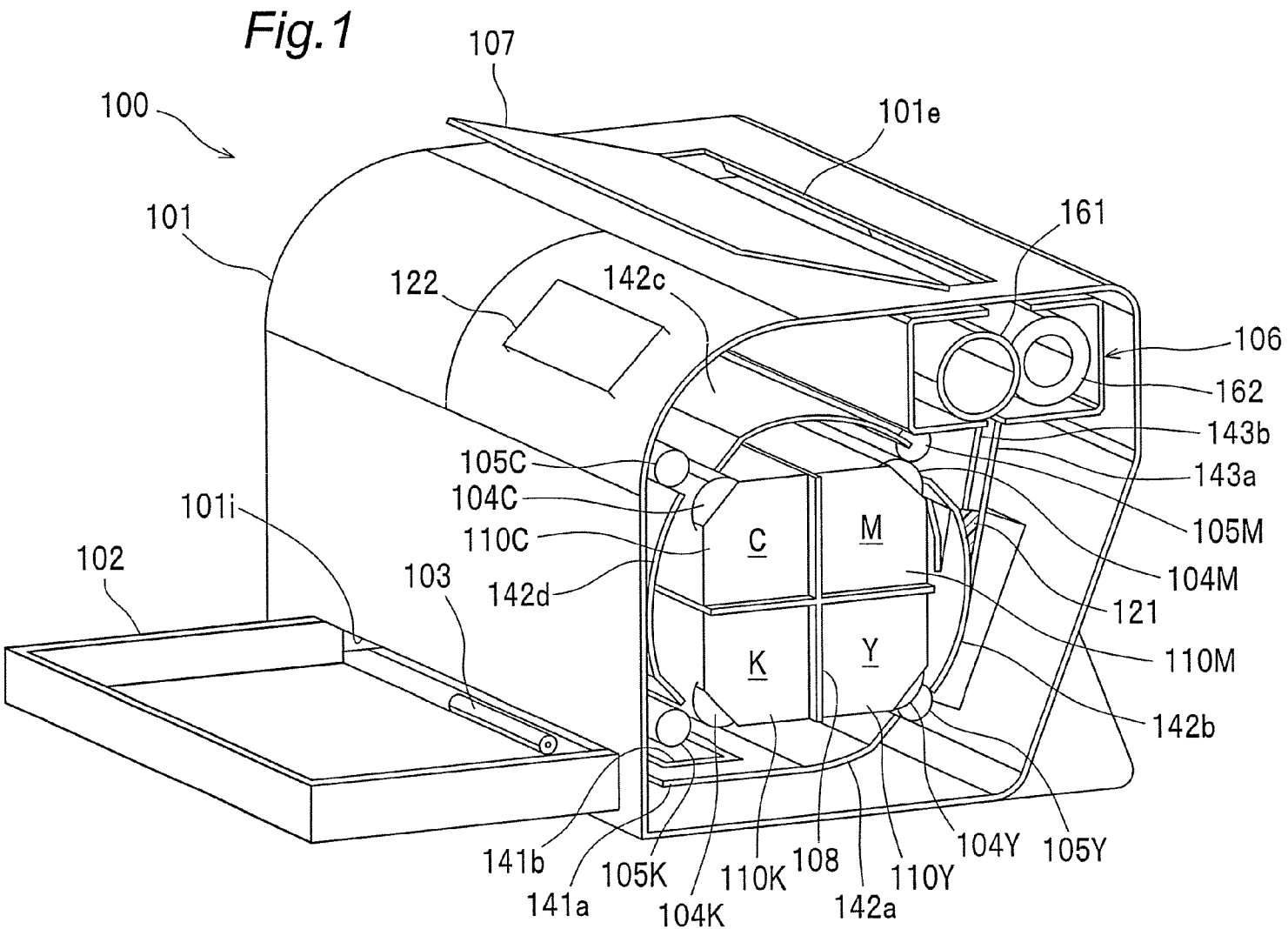
FIG. 1 is a view showing an image forming apparatus in a first embodiment of the invention as seen from a diagonally upward side.
Figure 2:
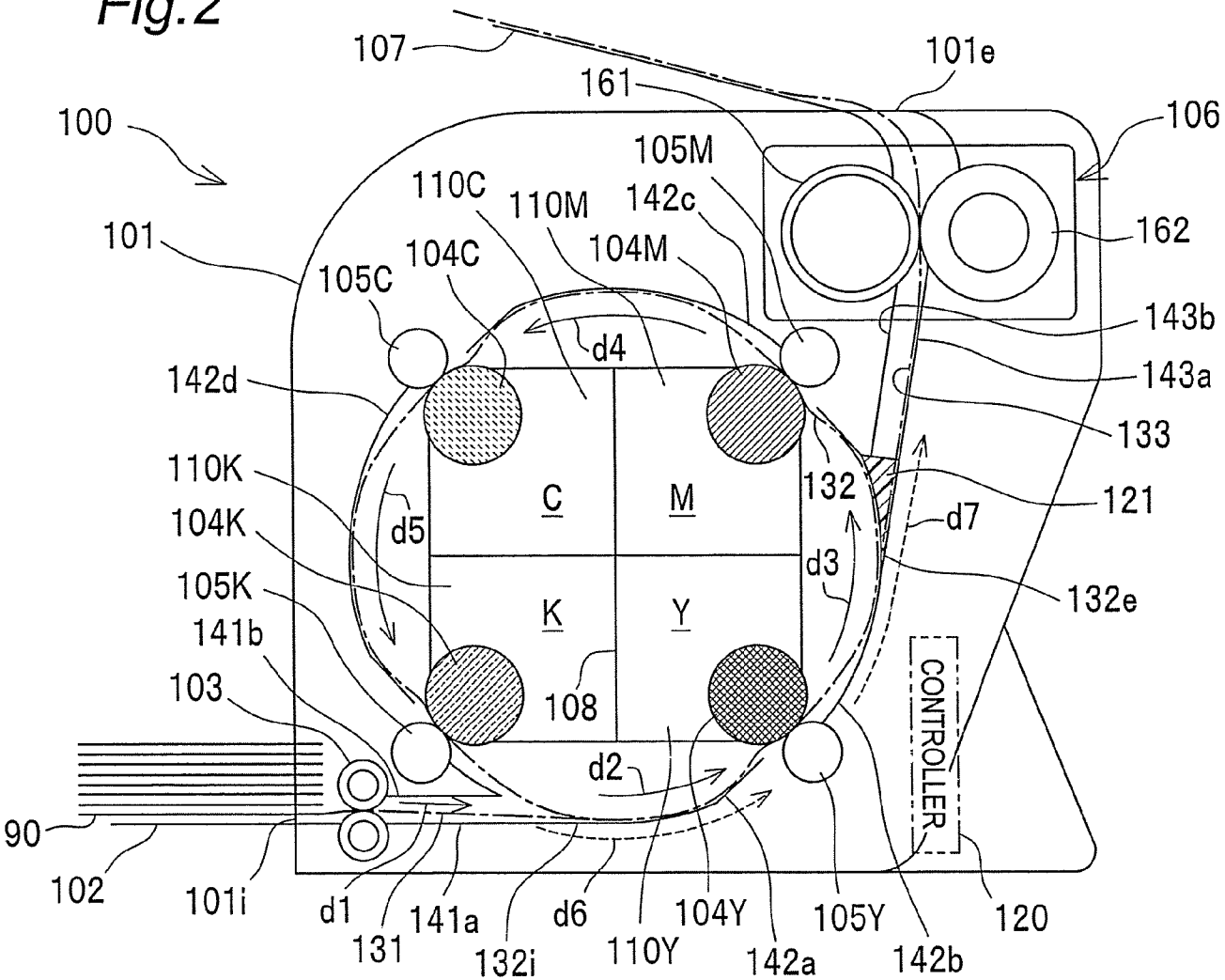
FIG. 2 is a view showing the sectional configuration of the image forming apparatus.

FIG. 1 shows an image forming apparatus (the entire frame is denoted by reference sign 100) in one embodiment of the invention as seen from the diagonally upward side, and FIG. 2 shows the sectional configuration of the image forming apparatus. In FIG. 1, the near side portion of the main body casing 101 is omitted to show the inside of the apparatus.

As shown in these drawings, the image forming apparatus 100 is composed of a main body casing 101, a plurality of image forming units Y, M, C and K (4 units in this example) placed generally in the central portion inside the main body casing 101, transfer rollers 105Y, 105M, 105C and 105K as opposed rollers provided corresponding to each of the image forming units Y, M, C and K, a fixing unit 106 as a fixing section placed in the upper part inside the main body casing 101, and a controller 120 as a control section for controlling the operation of the entire apparatus.

An opening 101*i* as an automatic feed opening is provided in the lower part of the main body casing 101. A paper feed tray 102 for storing paper sheets 90 as sheets is detachably mounted on the opening 101*i*. A pair of feeding rollers 103 is placed near the opening 101*i* inside the main body casing 101. The paper sheets 90 are sent from the paper feed tray 102 one by one into the main body casing by the pair of feeding rollers 103. In the upper part of the main body casing 101, an opening 101*e* as a discharge opening is provided. A paper ejection tray 107 is mounted on the opening 101*e*. Thus, the paper ejection tray 107 is provided in the upper part of the main body casing 101, so that the user can easily take out the sheets after image formation.

Inside the main body casing 101, an annular conveying path (shown by a dashed line in FIG. 2) 132 which is curved to have an annular shape (generally a ring shape in this example) is provided for conveying the paper sheets 90. The annular conveying path 132 is formed from four guide plates 142*a*, 142*b*, 142*c* and 142*d* supported by the main body casing 101.

A sheet introducing path (shown by a dashed line in FIG. 2) 131 extending in a generally horizontal direction is provided so that a nip section of the pair of feeding rollers 103 and a certain spot 132*i* of the lower part of the annular conveying path 132 (a portion between later-described pairs of transfer rollers (104K, 105K) and (104Y, 105Y) in this example) are connected. The sheet introducing path 131 is formed from guide plates 141*a* and 141*b* which are supported by the main body casing 101 and which face each other. The paper sheets 90 taken in the main body casing 101 by the pair of feeding rollers 103 are introduced to the annular conveying path 132 through the sheet introducing path 131 along a sheet conveying direction d1. This implements smooth automatic feeding of the paper sheets 90.

It is to be noted that an unshown paper sensor is provided in the paper feed tray 102. In the case where the paper sheets 90 are not set in the paper feed tray 102 or the paper sheets 90 are exhausted during operation, the information "paper empty" is sent to the controller 120. The controller 120 displays "paper empty" information on a display panel 122 (see FIG. 1) to notify the user.

Four image forming units Y, M, C and K are housed on the inner circumferential side of the annular conveying path 132 together with a holder 108. Four image forming units Y, M, C and K, which respectively extend from the near side of the apparatus toward the back side (equivalent to the width direction of the sheet) in FIG. 1 and FIG. 2, are integrally mounted on a holder 108 having a cross-like cross section supported by the main body casing 101. Accordingly, the four image forming units Y, M, C and K are generally formed, as a whole, as a rectangular bar which extends from the near side of the apparatus toward the back side. Since the four image forming units Y, M, C and K are integrally formed, downsizing becomes possible as compared with the case where they are formed separately.

The image forming unit Y is composed of a photoconductor drum 104Y as an image carrier roller, and an imaging section 110Y for forming an image of yellow as an intrinsic color on the surface of the photoconductor drum 104Y. Similarly, the image forming unit M is composed of a photoconductor drum 104M as an image carrier roller, and an imaging section 110M for forming an image of magenta as an intrinsic color on the surface of the photoconductor drum 104M. The image forming unit C is composed of a photoconductor drum 104C as an image carrier roller, and an imaging section 110C for forming an image of cyan as an intrinsic color on the surface of the photoconductor drum 104C. Moreover, the image forming unit K is composed of a photoconductor drum 104K as an image carrier roller, and an imaging section 110K for forming an image of black as an intrinsic color on the surface of the photoconductor drum 104K. The photoconductor drums 104Y, 104M, 104C and 104K are each placed at the corners far from the center of the holder 108 in the image forming units Y, M, C and K, and face the annular conveying path 132, respectively. In this example, the photoconductor drums 104Y, 104M, 104C and 104K are driven around each central shaft by unshown driving sections (such as motors) counter clockwise in the cross section of FIG. 2 during image formation.

Although unshown in the drawings, in order to form images with a publicly known electrophotographic method, the imaging sections 110Y, 110M, 110C and 110K in the respective image forming units are each composed of at least a charging section for uniformly charging the surface of the photoconductor drum of the image forming unit, an exposure section for forming a latent image on the surface of the photoconductor drum, a developing section for developing the latent image on the surface of the photoconductor drum to form a toner image, and a cleaning section for cleaning the surface of the photoconductor drum after transfer. The toner image on a paper sheet 90 is fixed onto the paper sheet 90 with the fixing unit 106.

As the data on images which should be exposed by the exposure section, data which is inputted, for example, directly from an unshown computer or via a network into the controller 120 of the image forming apparatus 1 can be used.

The transfer rollers 105Y, 105M, 105C and 105K as opposed rollers respectively corresponding to the photoconductor drums 104Y, 104M, 104C and 104K are provided in pressure contact with the photoconductor drums on the outer circumferential side of the annular conveying path 132. It is to be noted that pairs of the photoconductor drums and the transfer rollers in pressure contact with the photoconductor drums are referred to as pairs of transfer rollers (104Y, 105Y), (104M, 105M), (104C, 105C) and (104K, 105K).

As mentioned above, at the time of image formation, the photoconductor drums 104Y, 104M, 104C and 104K are driven around each central shaft counter clockwise in the cross section of FIG. 2. Following this rotation, the transfer rollers 105Y, 105M, 105C and 105K rotate around each central shaft clockwise in the cross section of FIG. 2. Accordingly, the paper sheet 90 may he conveyed through the annular conveying path 132 along the sheet conveying directions d2, d3 and d4. As a result, images are transferred onto the paper sheet 90 in a predetermined order that the images of respective colors should be transferred, i.e., in the order of yellow->magenta->cyan->black in this example. In other words, the pairs of transfer rollers (104Y, 105Y), (104M, 105M), (104C, 105C) and (104K, 105K) are placed so as to be juxtaposed along the inner circumference of the annular conveying path 132 in accordance with the order that the images of respective colors should be transferred at intervals of about 90 degrees.

A sheet releasing path (shown by a dashed line in FIG. 2) 133 extending aslant in a generally vertical direction is provided so that a certain spot 132*e* in the right side part of the annular conveying path 132 in FIG. 2 (a portion between the pairs of transfer rollers (104Y, 105Y) and (104M, 105M) in this example) and a nip section of the pair of fixing rollers 161, 162 of the fixing unit 106 are connected. The sheet releasing path 133 is formed from guide plates 143*a* and 143*b* which are supported by the main body casing 101 and which face each other. When the paper sheet 90, which passes the pair of transfer rollers (104Y, 105Y) and is conveyed upward along the sheet conveying direction d3 on the annular conveying path 132, comes to the spot 132*e*, the operation of a switching claw 121 controlled by the controller 120 switches between conveyance of the paper sheet 90 being continued on the annular conveying path 132 and release of the paper sheet 90 from the annular conveying path 132 to the sheet release path 133.

In the fixing unit 106, a pair composed of a heating roller 161 and a pressure roller 162 which is in pressure contact with the heating roller 161 is provided. This pair is referred to as a pair of fixing rollers (161, 162). The heating roller 161 is heated to a predetermined temperature (e.g., about 180° C.) at which the toner image on the paper sheet 90 should be fixed during operation. The pair of fixing rollers (161, 162) is driven in the direction for conveying the paper sheet 90 upward. As the paper sheet 90 is conveyed through the nip section of the pair of fixing rollers (161, 162), the toner image on the paper sheet 90 is fixed onto the paper sheet 90 upon reception of heat and pressure therefrom. The paper sheet 90 with the image fixed thereon by passing the fixing unit 106 is discharged onto the paper ejection tray 107 through the opening 101*e*.

At the time of color image formation, the image forming apparatus 100 operates as a whole as described below under control of the controller 120.

The controller 120 first operates the pair of feeding rollers 103 to take one paper sheet 90 from the paper feed tray 102 into the sheet introducing path 131 in the main body casing. The taken-in paper sheet 90 is introduced to the annular conveying path 132 along the sheet conveying direction d1 through the sheet introducing path 131. The paper sheet 90 introduced to the annular conveying path 132 is sent into the nip section of the pair of transfer rollers (104Y, 105Y) along the curved sheet conveying direction d2. In synchronization with this operation, the controller 120 operates the imaging section 110Y of the image forming unit Y to form a yellow toner image on the surface of the photoconductor drum 104Y. As the paper sheet 90 is conveyed through the nip section of the pair of transfer rollers (104Y, 105Y), the yellow toner image is transferred onto the paper sheet 90. The paper sheet 90 which has passed the pair of transfer rollers (104Y, 105Y) reaches the spot 132*e*. In this case, under control of the switching claw 121 by the controller 120, conveyance of the paper sheet on the annular conveying path 132 is continued. Next, the paper sheet 90 is sent into the nip section of the pair of transfer rollers (104M, 105M) along the curved sheet conveying direction d3. In synchronization with this operation, the controller 120 operates the imaging section 110M of the image forming unit M to form a magenta toner image on the surface of the photoconductor drum 104M. As the paper sheet 90 is conveyed through the nip section of the pair of transfer rollers (104M, 105M), the magenta toner image is transferred onto the paper sheet 90. Next, the paper sheet 90 is sent into the nip section of the pair of transfer rollers (104C, 105C) along the curved sheet conveying direction d4. In synchronization with this operation, the controller 120 operates the imaging section 110C of the image forming unit C to form a cyan toner image on the surface of the photoconductor drum 104C. As the paper sheet 90 is conveyed through the nip section of the pair of transfer rollers (104C, 105C), the cyan toner image is transferred onto the paper sheet 90. Next, the paper sheet 90 is sent into the nip section of the pair of transfer rollers (104K, 105K) along the curved sheet conveying direction d5. In synchronization with this operation, the controller 120 operates the imaging section 110K of the image forming unit K to form a black toner image on the surface of the photoconductor drum 104K. As the paper sheet 90 is conveyed through the nip section of the pair of transfer rollers (104K, 105K), the black toner image is transferred onto the paper sheet 90. Thus, the transfer of the images of four colors which should be transferred onto the paper sheet 90 is completed.

Then, the paper sheet 90 is again sent into the nip section of the pair of transfer rollers (104Y, 105Y) along the curved sheet conveying direction d6. At this time, the controller 120 stops operation of the imaging section 110Y of the image forming unit Y, and operates the pair of transfer rollers (104Y, 105Y) only for conveyance. More specifically, after the paper sheet 90 passes the pair of transfer rollers (104K, 105K) of the black color which should be transferred at last, the pairs of transfer rollers, which are passed by the paper sheet 90 till the paper sheet 90 reaches the spot 132*e* where the sheet is released, are operated only for conveyance. In this case, an additional yellow toner image is not transferred on the paper sheet 90 which has the images of four colors already transferred thereon. In short, further transfer of images of unnecessary colors is not performed. Therefore, sufficient image quality is achieved, while resource saving is also achieved thereby. The paper sheet 90 which has passed the pair of transfer rollers (104Y, 105Y) reaches the spot 132*e* where the sheet should be released. In this case, the controller 120 controls the switching claw 121 so that the paper sheet 90 is released from the annular conveying path 132 to the sheet release path 133 along the sheet conveying direction d7.

The paper sheet 90 sent to the sheet release path 133 is conveyed through the nip section of the pair of fixing rollers (161, 162) inside the fixing unit 106. The toner image on the paper sheet 90 is fixed onto the paper sheet 90 with the fixing unit 106.

The paper sheet 90 with the image fixed thereon by passing the fixing unit 106 is discharged onto the paper ejection tray 107 through the opening 101*e*. Thus, the toner image on the paper sheet 90 is fixed onto the paper sheet 90. The paper sheet 90 with the image fixed thereon by passing the fixing unit 106 is discharged onto the paper ejection tray 107 through the opening 101*e*.

Thus, after traveling the annular conveying path 132 once to undergo four transfer operations of the toner images (e.g., toner images of four colors: yellow; cyan; magenta; and black), the paper sheet 90 passes the fixing unit 106 once, by which color image formation with electrophotographic method is implemented.

It is to be noted that the length of the annular conveying path 132 along the sheet conveying directions d2, d3, d4 and d5 are set to be longer than the size of the paper sheet 90 with respect to the sheet conveying direction. With this setting, the top end and the tail end of the paper sheet 90 do not overlap and the paper sheet 90 is conveyed smoothly.

At the time of monochrome image formation, the image forming apparatus 100 operates as a whole as described below under control of the controller 120.

First, as is the case of color image formation, the paper sheet 90 is introduced from the paper feed tray 102 to the annular conveying path 132 through the sheet introducing path 131 along the sheet conveying direction d1. The paper sheet 90 introduced to the annular conveying path 132 is conveyed sequentially through the pairs of transfer rollers (104Y, 105Y), (104M, 105M), and (104C, 105C) along the curved sheet conveying direction d2, d3, and d4. At this time, the controller 120 stops operation of the imaging sections 110Y, 110M and 110C of the image forming units Y, M and C, and operates the pairs of transfer rollers (104Y, 105Y), (104M, 105M) and (104C, 105C) only for conveyance. In short, the pairs of transfer rollers, which are passed by the paper sheet 90 till the paper sheet 90 reaches the pair of transfer rollers (104K, 105K) of the black color which should be transferred first, are operated only for conveyance.

Next, the paper sheet 90 is sent into the nip section of the pair of transfer rollers (104K, 105K) along the curved sheet conveying direction d5. In synchronization with this operation, the controller 120 operates the imaging section 110K of the image forming unit K to form a black toner image on the surface of the photoconductor drum 104K. As the paper sheet 90 is conveyed through the nip section of the pair of transfer rollers (104K, 105K), the black toner image is transferred onto the paper sheet 90. Thus, the transfer of the black image which should be transferred onto the paper sheet 90 is completed.

Then, the paper sheet 90 is again sent into the nip section of the pair of transfer rollers (104Y, 105Y) along the curved sheet conveying direction d6. At this time, as is the case of the color image formation, the controller 120 stops operation of the imaging section 110Y of the image forming unit Y, and operates the pair of transfer rollers (104Y, 105Y) only for conveyance. The paper sheet 90 which has passed the pair of transfer rollers (104Y, 105Y) reaches the spot 132*e* where the sheet should be released. In this case, the controller 120 controls the switching claw 121 so that the paper sheet 90 is released from the annular conveying path 132 toward the sheet release path 133 along the sheet conveying direction d7.

The paper sheet 90 sent to the sheet release path 133 is sent to the nip section of the pair of fixing rollers (161, 162) inside the fixing unit 106. The toner image on the paper sheet 90 is fixed onto the paper sheet 90 with the fixing unit 106. The paper sheet 90 with the image fixed thereon by passing the fixing unit 106 is discharged onto the paper ejection tray 107 through the opening 101*e*.

In this way, images of unnecessary colors other than the black color are not transferred onto the paper sheet 90. Therefore, sufficient image quality is achieved, while resource saving is also achieved.

In the image forming apparatus 100, a plurality of the pairs of transfer rollers (104Y, 105Y), (104M, 105M), (104C, 105C) and (104K, 105K) are placed so as to be juxtaposed on the annular conveying path 132 along the sheet conveying direction d2, d3, d4 and d5. Therefore, as compared with the apparatus configured so that a plurality of pairs of transfer rollers are linearly placed on one row as in the case of JP H07-319254 A, the image forming apparatus 100 is configured to be small. Moreover, the annular conveying path 132 is curved to have an annular shape. Therefore, even when the conveying speeds of the respective pairs of transfer rollers (104Y, 105Y), (104M, 105M), (104C, 105C), and (104K, 105K) vary to some extent, the paper sheet 90 is curved in between the pairs of transfer rollers and has enough allowance for tensile stress, so that it becomes possible to avoid excessive load from being applied onto the sheet. As a result, sufficient conveyance stability and image quality of the sheet can be maintained.

Second Embodiment

Figure 3:
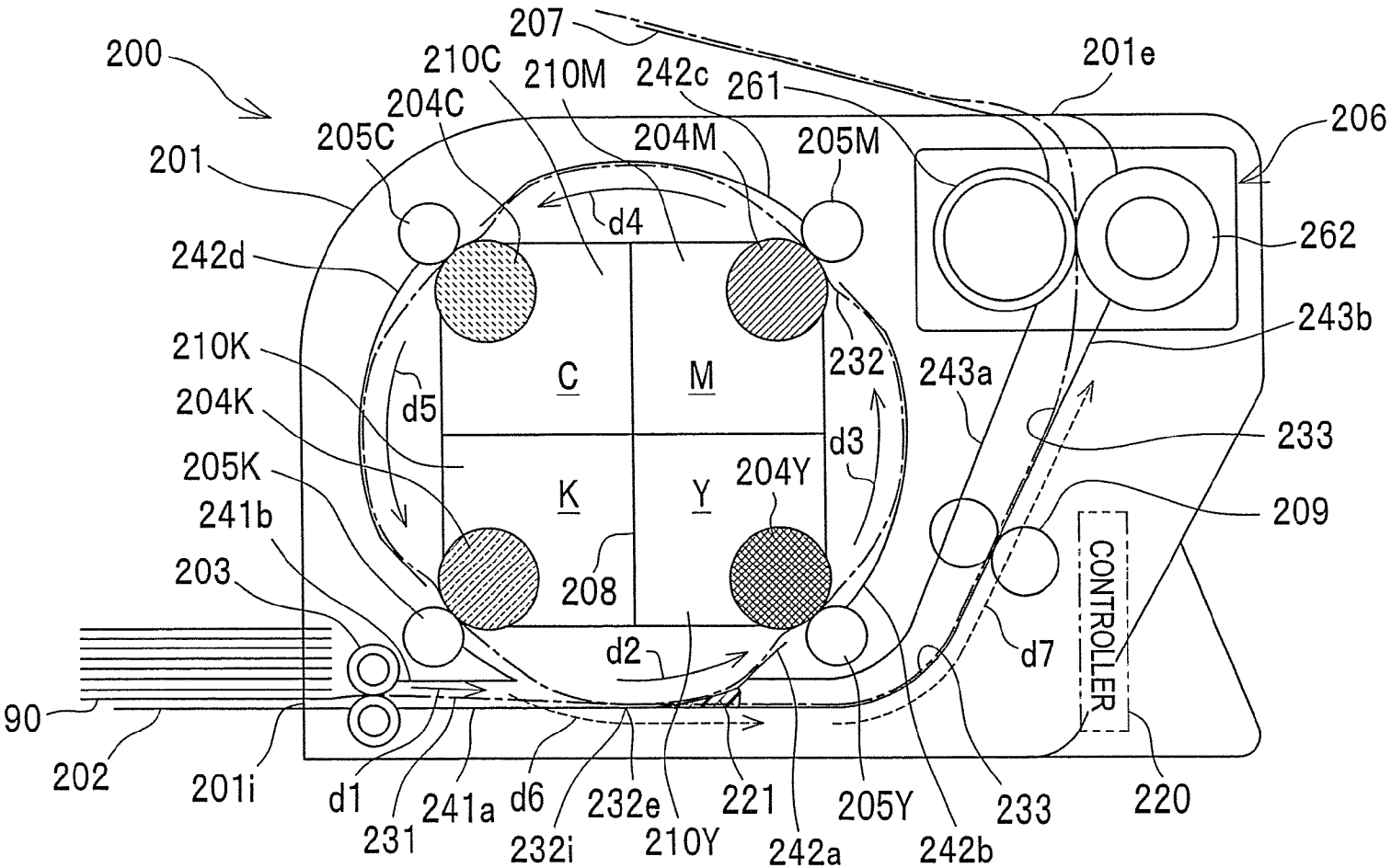
FIG. 3 is a view showing the sectional configuration of an image forming apparatus in a second embodiment of the present invention.

FIG. 3 shows the sectional configuration of an image forming apparatus (the entire frame is denoted by reference sign 200) as a modified example of the aforementioned image forming apparatus 100. In FIG. 3, the component members corresponding to those in FIG. 2 are denoted by reference numerals with 100 added thereto. Thus, redundant description about each component is omitted.

The image forming apparatus 200 is different from the image forming apparatus 100 in the point that a sheet release path 233 is connected to a certain spot (a spot where the sheet should be released) 232*e* in the lower part of an annular conveying path 232 (the part between pairs of transfer rollers (204K, 205K) and (204Y, 205Y) in this example). It is to be noted that in this example, the spot 232*e* where the sheet should be released is congruous with a spot 232*i* where the sheet is introduced. In order to smoothly convey the paper sheet 90 which has been released from the annular conveying path 232 to the nip section of a pair of fixing rollers 261, 262 of a fixing unit 206, the sheet release path 233 has a pair of conveying rollers 209.

At the time of color image formation, the image forming apparatus 200 operates as a whole as described below under control of a controller 220.

First, the paper sheet 90 is introduced from a paper feed tray 202 to the annular conveying path 232 through a sheet introducing path 231 along the sheet conveying direction d1. The controller 220 conveys the paper sheet 90 introduced to the annular conveying path 232 sequentially through pairs of transfer rollers (204Y, 205Y), (204M, 205M), (204C, 205C) and (204K, 205K) along the curved sheet conveying direction d2, d3 and d4, while transferring mages formed on the surfaces of each of the photoconductor drums 204Y, 204M, 204C and 204K by imaging sections 210Y, 210M, 210C and 210K one by one onto the paper sheet 90. Thus, the transfer of the images of four colors which should be transferred onto the paper sheet 90 is completed.

The paper sheet 90 which has passed the pair of transfer rollers (204K, 205K) reaches the spot 232*e* where the sheet should be released. In this case, the controller 220 controls a switching claw 221 so that the paper sheet 90 is released from the annular conveying path 232 toward the sheet release path 233 along the sheet conveying direction d7.

The paper sheet 90 sent to the sheet release path 233 is conveyed through the pair of conveying rollers 209, and is further sent into the nip section of a pair of fixing rollers (261, 262) in the fixing unit 206. The toner image on the paper sheet 90 is fixed onto the paper sheet 90 with the fixing unit 206.

The paper sheet 90 with the image fixed thereon by passing the fixing unit 206 is discharged onto a paper ejection tray 207 through an opening 201*e*.

At the time of monochrome image formation, the image forming apparatus 200 operates as a whole as described below under control of the controller 220.

First, as is the case of color image formation, the paper sheet 90 is introduced from the paper feed tray 202 to the annular conveying path 232 through the sheet introducing path 231 along the sheet conveying direction d1. The paper sheet 90 introduced to the annular conveying path 232 is conveyed sequentially through the pairs of transfer rollers (204Y, 205Y), (204M, 205M), and (204C, 205C) along the curved sheet conveying direction d2, d3, and d4. At this time, the controller 220 stops operation of the imaging sections 210Y, 210M and 210C of the image forming units Y, M and C, and operates the pairs of transfer rollers (204Y, 205Y), (204M, 2105M) and (204C, 205C) only for conveyance. In short, the pairs of transfer rollers, which are passed by the paper sheet 90 till the paper sheet 90 reaches the pair of transfer rollers (204K, 205K) of the black color which should be transferred first, are operated only for conveyance.

Next, the paper sheet 90 is sent into the nip section of the pair of transfer rollers (204K, 205K) along the curved sheet conveying direction d5. In synchronization with this operation, the controller 220 operates the imaging section 210K of the image forming unit K to form a black toner image on the surface of the photoconductor drum 204K. As the paper sheet 90 is conveyed through the nip section of the pair of transfer rollers (204K, 205K), the black toner image is transferred onto the paper sheet 90. Thus, the transfer of the black image which should be transferred onto the paper sheet 90 is completed.

Then, the paper sheet 90 reaches the spot 232*e* where the sheet should be released. In this case, the controller 220 controls the switching claw 221 so that the paper sheet 90 is released from the annular conveying path 232 toward the sheet release path 233 along the sheet conveying direction d7.

The paper sheet 90 sent to the sheet release path 233 is conveyed through the pair of conveying rollers 209, and is further sent into the nip section of the pair of fixing rollers (261, 262) in the fixing unit 206. The toner image on the paper sheet 90 is fixed onto the paper sheet 90 with the fixing unit 206. The paper sheet 90 with the image fixed thereon by passing the fixing unit 206 is discharged onto the paper ejection tray 207 through the opening 201*e*. It is to be noted that the pair of conveying rollers 209 may be replaced with a means, such as suction belts, which conveys the paper sheet 90 while holding only the one side of the paper sheet 90 along the back side of the surface of the paper sheet 90 on which a toner image is formed, i.e., along the right side of the sheet release path 233 in FIG. 3. With this means provided, it becomes possible to reduce the possibility that the toner image before being fixed is damaged during conveyance.

The image forming apparatus 200 can implement the same operation effect as the image forming apparatus 100 as described before. Furthermore, the paper sheet 90 is released from the annular conveying path 232 after the paper sheet 90 travels the annular conveying path 232 once to undergo four transfer operations of the toner images (e.g., toner images of four colors: yellow; cyan; magenta; and black) and before the paper sheet 90 reaches the next pair of transfer rollers (204Y, 205Y). Therefore, the paper sheet 90 is not influenced by the remaining toner or the like on the photoconductor drum 204Y after completion of the transfer operation in the pair of transfer rollers (204Y, 205Y). Therefore, more sufficient image quality can be maintained.

Third Embodiment

Figure 4:
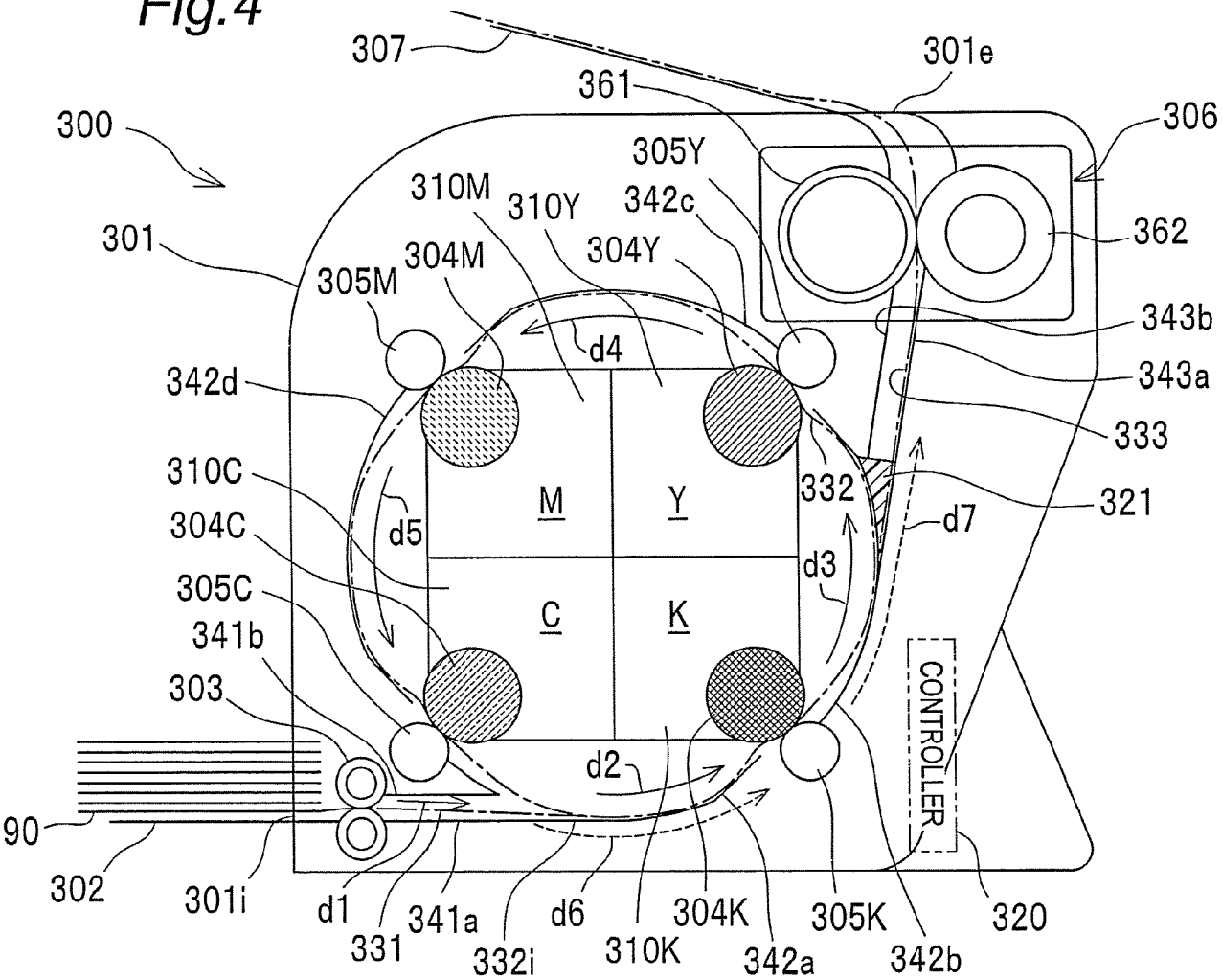
FIG. 4 is a view showing the sectional configuration of an image forming apparatus in a third embodiment of the present invention.

FIG. 4 shows the sectional configuration of an image forming apparatus (the entire frame is denoted by reference sign 300) as a modified example of the aforementioned image forming apparatus 100. In FIG. 4, the component members corresponding to those in FIG. 2 are denoted by reference numerals with 200 added thereto. Thus, redundant description about each component is omitted.

The image forming apparatus 300 is different from the aforementioned image forming apparatus 100 in the placement of pairs of transfer rollers (304Y, 305Y), (304M, 305M), (304C, 305C) and (304K, 305K). More specifically, as shown in FIG. 2, in the above-mentioned image forming apparatus 100, the pairs of transfer rollers were placed so as to be juxtaposed in the order of (104Y, 105Y), (104M, 105M), (104C, 105C) and (104K, 105K), as seen from the spot 132*i* where the sheet is introduced, along the inner circumference of the annular conveying path 132 at angle intervals of about 90 degrees. On the contrary, in the image forming apparatus 300, the pairs of transfer rollers are placed so as to be juxtaposed in the order of (304K, 305K), (304Y, 305Y), (304M, 305M) (304C, 305C), as seen from a spot 332*i* (lower side) where the sheet is introduced, along the inner circumference of an annular conveying path 332 at angle intervals of about 90 degrees. A spot 332*e* where the sheet should be released is provided in the right side part of the annular conveying path 332 in FIG. 4, that is, in between the pairs of transfer rollers (304K, 305K) and (304Y, 305Y) in this example.

The image forming apparatus 300 is characterized in that a sheet introducing path 331 is connected to the spot 332*i* which locates immediately before the pair of transfer rollers (304K, 305K) in the annular conveying path 332 while a sheet release path 333 is connected to the spot 332*e* which locates immediately after the pair of transfer rollers (304K, 305K) in the annular conveying path 332. The sheet introducing path 331 and the sheet release path 333 are circumscribed to the annular conveying path 332.

At the time of color image formation, the image forming apparatus 300 operates as a whole as described below under control of a controller 320.

The paper sheet 90 is introduced from a paper feed tray 302 into the annular conveying path 332 through the sheet introducing path 331 along the sheet conveying direction d1. The paper sheet 90 introduced to the annular conveying path 332 is sent into the nip section of the pair of transfer rollers (304K, 305K) along the curved sheet conveying direction d2. At this time, the controller 320 stops operation of an imaging section 310K of the image forming unit K, and operates the pair of transfer rollers (304K, 305K) only for conveyance. In short, the pair of transfer rollers, which is passed by the paper sheet 90 till the paper sheet 90 reaches the pair of transfer rollers (304Y, 305Y) of the yellow color which should be transferred first, is operated only for conveyance.

Next, the controller 320 conveys the paper sheet 90 sequentially through the pairs of transfer rollers (304Y, 305Y), (304M, 305M), (304C, 305C) and (304K, 305K) along the curved sheet conveying directions d3, d4, d5 and d6, while transferring images formed on the surfaces of each of the photoconductor drums 304Y, 304M, 304C and 304K by the imaging sections 310Y, 310M, 310C and 310K one by one onto the paper sheet 90. Thus, the transfer of the images of four colors which should be transferred onto the paper sheet 90 is completed.

The paper sheet 90 which has passed the pair of transfer rollers (304K, 305K) reaches the spot 332*e* where the sheet should be released. In this case, the controller 320 controls a switching claw 321 so that the paper sheet 90 is released from the annular conveying path 332 toward the sheet release path 333 along the sheet conveying direction d7.

The paper sheet 90 sent to the sheet release path 333 is sent to the nip section of a pair of fixing rollers (361, 362) inside a fixing unit 306. The toner image on the paper sheet 90 is fixed onto the paper sheet 90 with the fixing unit 306. The paper sheet 90 with the image fixed thereon by passing the fixing unit 306 is discharged onto a paper ejection tray 307 through an opening 301*e*.

At the time of monochrome image formation, the image forming apparatus 300 operates as a whole as described below under control of the controller 320.

Figure 6:
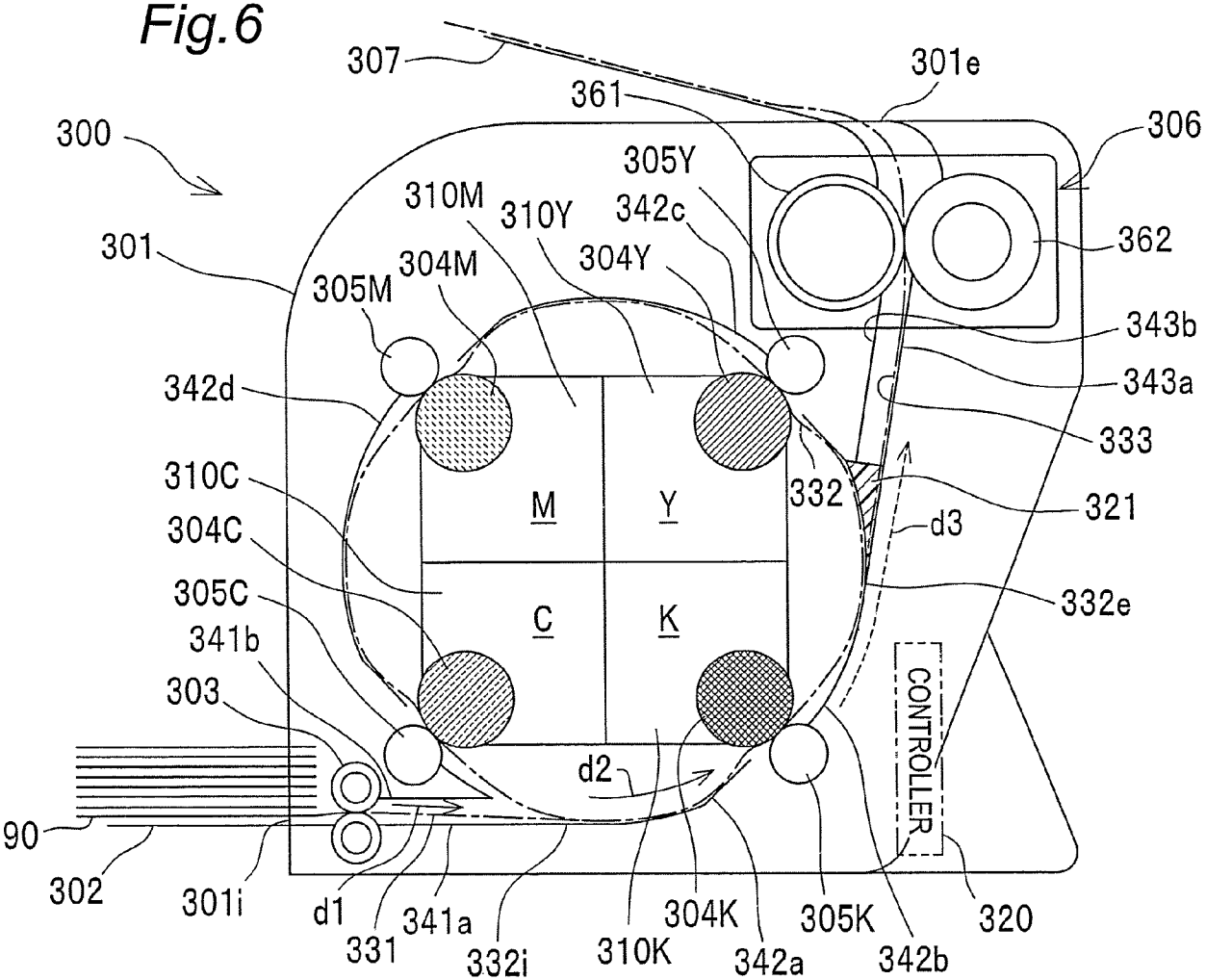
FIG. 6 is a view explaining the operation for forming a monochrome image with the image forming apparatus shown in FIG. 4.

First, as is the case of color image formation, the paper sheet 90 is introduced from the paper feed tray 302 to the annular conveying path 332 through the sheet introducing path 331 along the sheet conveying direction d1 as shown in FIG. 6. The paper sheet 90 introduced to the annular conveying path 332 is sent into the nip section of the pair of transfer rollers (304K, 305K) along the curved sheet conveying direction d2. In synchronization with this operation, the controller 320 operates the imaging section 310K of the image forming unit K to form a black toner image on the surface of the photoconductor drum 304K. As the paper sheet 90 is conveyed through the nip section of the pair of transfer rollers (304K, 305K), the black toner image is transferred onto the paper sheet 90. Thus, the transfer of the black image which should be transferred onto the paper sheet 90 is completed.

Next, the paper sheet 90 reaches the spot 332e where the sheet should be released. In this case, the controller 320 controls the switching claw 321 so that the paper sheet 90 is released from the annular conveying path 332 toward the sheet release path 333 along the sheet conveying direction d3.

The paper sheet 90 sent to the sheet release path 333 is sent into the nip section of the pair of fixing rollers (361, 362) in the fixing unit 306. The toner image on the paper sheet 90 is fixed onto the paper sheet 90 with the fixing unit 306. The paper sheet 90 with the image fixed thereon by passing the fixing unit 306 is discharged onto the paper ejection tray 307 through the opening 301*e*.

In the image forming apparatus 300, the sheet introducing path 331 is connected to the spot 332*i* which locates immediately before the pair of transfer rollers (304K, 305K) in the annular conveying path 332, while the sheet release path 333 is connected to the spot 332*e* which locates immediately after the pair of transfer rollers (304K, 305K) in the annular conveying path 332. Therefore, in the image forming apparatus, the path on which the paper sheet 90 as a sheet is conveyed during monochrome image formation is the path which involves only the pair of black transfer rollers (304K, 305K) among a plurality of the pairs of transfer rollers, so that output of the sheet (the first sheet in the case of the printing job of a plurality of pages) becomes fast. Since images of colors other than black color are not transferred onto the sheet, resources are not wasted and energy saving becomes possible. Furthermore, the sheet introducing path 331 and the sheet release path 333 are circumscribed to the annular conveying path 332. Consequently, the path to convey the paper sheet 90 as a sheet during monochrome image formation becomes substantially the shortest. Therefore, output of the sheet (the first sheet in the case of the printing job of a plurality of pages) becomes faster.

Fourth Embodiment

Figure 5:
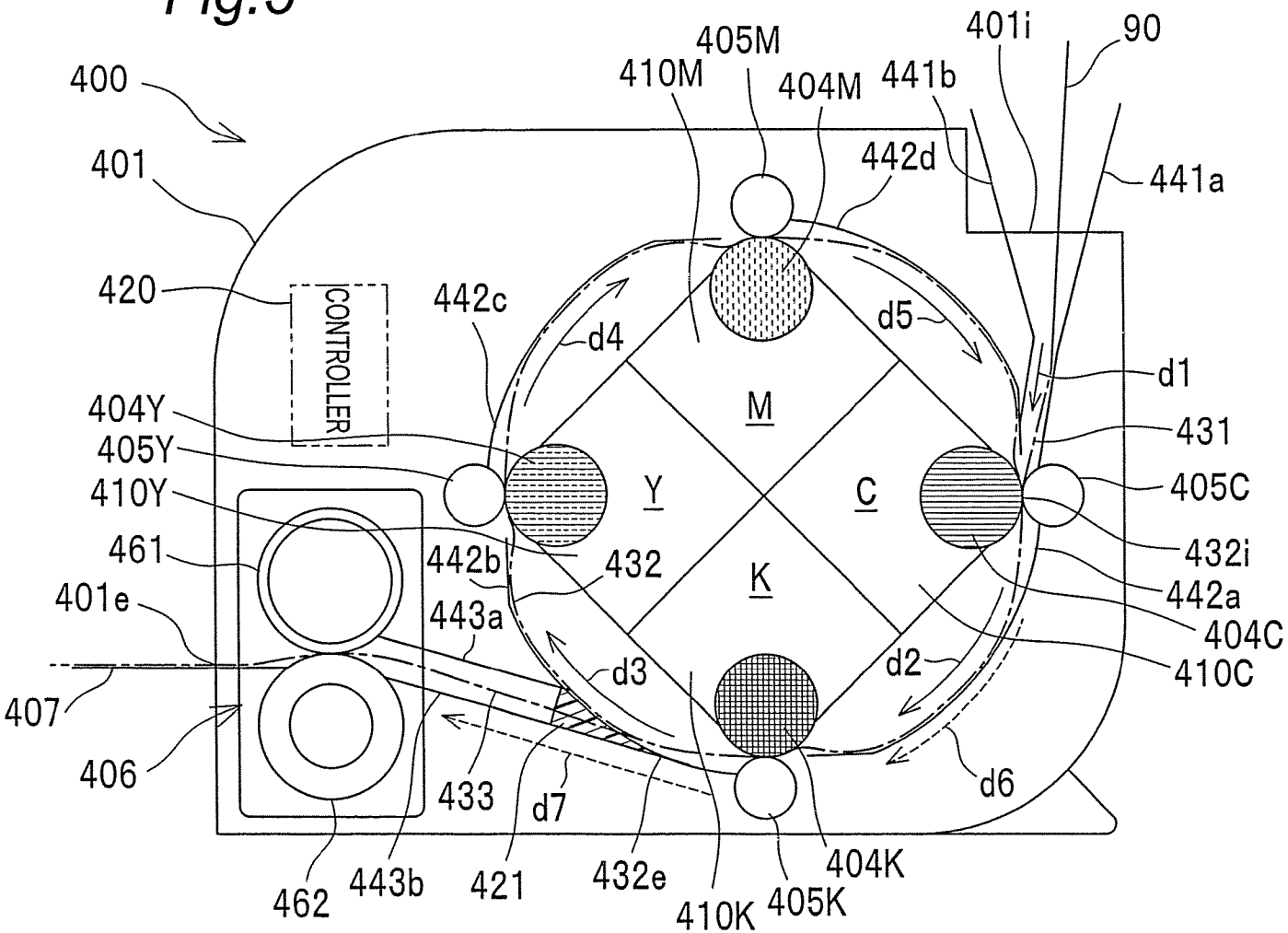
FIG. 5 is a view showing the sectional configuration of an image forming apparatus in a fourth embodiment of the present invention.

FIG. 5 shows the sectional configuration of an image forming apparatus (the entire frame is denoted by reference sign 400) in another embodiment of the invention. In FIG. 5, the component members corresponding to those in FIG. 2 are denoted by reference numerals with 300 added thereto. Thus, redundant description about each component is omitted.

The image forming apparatus 400 is different from the above-mentioned image forming apparatus 100 in the point that the apparatus is of a simplified type specialized in manual paper feed.

More specifically, a manual paper feed opening (opening) 401*i* is provided in the upper part of a main body casing 401, i.e., on the upper side of an annular conveying path 432. An unshown paper sensor is provided in the manual paper feed opening 401*i*. The manual paper feed opening 401*i* and the annular conveying path 432 are connected by a sheet introducing path 431 extending in a generally vertical direction. When the user inserts a paper sheet 90 as a sheet into the manual paper feed opening 401*i*, the paper sensor detects the paper feed. Based on the output of the paper sensor, a controller 420 starts image forming operation. In the image forming apparatus 400, the paper sheet 90 as a sheet is fed from the manual paper feed opening 401*i* through the sheet introducing path 431 extending in the generally vertical direction with use of gravity. Therefore, manual feeding of the sheets is performed smoothly.

In the image forming apparatus 400, the pairs of transfer rollers are placed so as to be juxtaposed in the order of (404C, 405C), (404K, 405K), (404Y, 405Y) and (404M, 405M), as seen from a spot 432*i* (right side part) where the sheet is introduced, along the inner circumference of the annular conveying path 432 at angle intervals of about 90 degrees. A spot 432*e* where the sheet should be released is provided in the lower part of the annular conveying path 332 in FIG. 4, that is, in between the pairs of transfer rollers (404K, 405K) and (404Y, 405Y) in this example.

A fixing unit 406 is provided in the lower part inside the main body casing 401. The sheet release path 433 extending in the generally horizontal direction connects the spot 432*e* in the annular conveying paths 432 where the sheet should be released and the nip section of a pair of fixing rollers (461, 462) in the fixing unit 406. An opening 401e as a sheet discharge opening is provided in the lower part of the main body casing 401 and adjacent to the fixing unit 406. A paper ejection tray 407 is attached to the opening 401*e*.

At the time of color image formation, the image forming apparatus 400 operates as a whole as described below under control of the controller 420.

The paper sheet 90 is introduced from the manual paper feed opening 401*i* to the annular conveying path 432 through the sheet introducing path 431 along the sheet conveying direction d1. The paper sheet 90 introduced to the annular conveying path 432 is conveyed sequentially through the pairs of transfer rollers (404C, 405C) and (404K, 405K) along the curved sheet conveying directions d2 and d3. At this time, the controller 420 stops operation of imaging sections 410C and 410K of the image forming units C and K, and operates the pairs of transfer rollers (404C, 405C) and (404K, 405K) only for conveyance. In short, the pairs of transfer rollers, which are passed by the paper sheet 90 till the paper sheet 90 reaches the pair of transfer rollers (404Y, 405Y) of the yellow color which should be transferred first, are operated only for conveyance.

Then, the controller 420 conveys the paper sheet 90 sequentially through the pairs of transfer rollers (404Y, 405Y), (404M, 405M), (404C, 405C) and (404K, 405K) along the curved sheet conveying directions d4, d5 and d6, while transferring images formed on the surfaces of each of the photoconductor drums 404Y, 404M, 404C and 404K by the imaging sections 410Y, 410M, 410C and 410K one by one onto the paper sheet 90. Thus, the transfer of the images of four colors which should be transferred onto the paper sheet 90 is completed.

The paper sheet 90 which has passed the pair of transfer rollers (404K, 405K) reaches the spot 432*e* where the sheet should be released. In this case, the controller 420 controls a switching claw 421 so that the paper sheet 90 is released from the annular conveying path 432 toward the sheet release path 433 along the sheet conveying direction d7.

The paper sheet 90 sent to the sheet release path 433 is sent to the nip section of the pair of fixing rollers (461, 462) inside the fixing unit 406. The toner image on the paper sheet 90 is fixed onto the paper sheet 90 with the fixing unit 406. The paper sheet 90 with the image fixed thereon by passing the fixing unit 406 is discharged onto the paper ejection tray 407 through the opening 401*e*.

At the time of monochrome image formation, the image forming apparatus 400 operates as a whole as described below under control of the controller 420.

First, as is the case of color image formation, the paper sheet 90 is introduced from the manual paper feed opening 401*i* to the annular conveying path 432 through the sheet introducing path 431 along the sheet conveying direction d1. The paper sheet 90 introduced to the annular conveying path 132 is sent into the nip section of the pair of transfer rollers (404C, 405C). At this time, the controller 420 stops operation of the imaging section 410C of the image forming unit C, and operates the pair of transfer rollers (404C, 405C) only for conveyance. In short, the pair of transfer rollers, which is passed by the paper sheet 90 till the paper sheet 90 reaches the pair of transfer rollers (404K, 405K) of the black color which should be transferred first, is operated only for conveyance.

Next, the paper sheet 90 is sent into the nip section of the pair of transfer rollers (404K, 405K) along the curved sheet conveying direction d2. In synchronization with this operation, the controller 420 operates the imaging section 410K of the image forming unit K to form a black toner image on the surface of the photoconductor drum 404K. As the paper sheet 90 is conveyed through the nip section of the pair of transfer rollers (404K, 405K), the black toner image is transferred onto the paper sheet 90. Thus, the transfer of the black image which should be transferred onto the paper sheet 90 is completed.

The paper sheet 90 which has passed the pair of transfer rollers (404K, 405K) reaches the spot 432*e* where the sheet should be released. In this case, the controller 420 controls the switching claw 421 so that the paper sheet 90 is released from the annular conveying path 432 toward the sheet release path 433 along the sheet conveying direction d7.

The paper sheet 90 sent to the sheet release path 433 is sent to the nip section of the pair of fixing rollers (461, 462) inside the fixing unit 406. The toner image on the paper sheet 90 is fixed onto the paper sheet 90 with the fixing unit 406. The paper sheet 90 with the image fixed thereon by passing the fixing unit 406 is discharged onto the paper ejection tray 407 through the opening 401*e*.

Thus, the image forming apparatus which can offer manual paper feed with a relatively easy configuration can be implemented.

In each of the aforementioned examples, the invention is applied to the electrophotographic image forming apparatus. However, the present invention is not limited to this example. The invention may also be applied to the image forming apparatuses employing methods other than the electrophotographic method.

The invention may widely be applied not only to the image forming apparatuses having four pairs of transfer rollers but also to image forming apparatuses having a plurality of pairs of transfer rollers, such as the image forming apparatuses having three pairs of transfer rollers.

As a sheet, not only paper but also plastic films such as OHP (overhead projector) films can also be used.

As an auxiliary means for paper sheet conveyance, a means to convey the paper sheets while holding only one side of the paper sheets such as suction belts may be provided along the outer circumferential side of the annular conveying path.

As is described above, the image forming apparatus according to the present invention comprises:

an annular conveying path which is curved to have an annular shape;

a plurality of image carrier rollers placed on an inner circumferential side of the annular conveying path so as to face the annular conveying path and so as to be juxtaposed in a sheet conveying direction along the annular conveying path;

opposed rollers provided on an outer circumferential side of the annular conveying path so as to be in pressure contact with each of the image carrier rollers to constitute pairs of transfer rollers together with each of the image carrier rollers;

imaging sections for forming intrinsic color images on surfaces of the respective image carrier rollers; and a control section for controlling so that a sheet is introduced to the annular conveying path and is passed sequentially through nip sections of the pairs of transfer rollers so as to be conveyed along the sheet conveying direction, while images, which are formed on surfaces of the respective image carrier rollers by the imaging sections, are transferred one by one onto the sheet, and the sheet with the images transferred thereon are released from the annular conveying path.

In the image forming apparatus in one embodiment, the image carrier roller is constituted of a photoconductor drum, wherein the imaging section comprises at least: a charging section for uniformly charging the surface of each of the photoconductor drums; an exposure section for forming a latent image on the surface of each of the photoconductor drums; and a developing section for developing the latent image on the surface of each of the photoconductor drums to form a toner image, and wherein the image forming apparatus further comprises a fixing section for fixing the toner image on the sheet, which has been released from the annular conveying path, onto the sheet.

In the image forming apparatus in this one embodiment, after traveling the annular conveying path once to undergo a plurality of transfer operations of the toner images (e.g., toner images of four colors: yellow; cyan; magenta; and black), the paper sheet passes the fixing section once, by which color image formation with electrophotographic method is implemented.

In the image forming apparatus in one embodiment, a plurality of the image carrier rollers are integrally formed.

In the image forming apparatus in this one embodiment, a plurality of the image carrier rollers are integrally formed, so that further downsizing becomes possible as compared with the case where a plurality of the image carrier rollers are separated from each other.

The phrase "a plurality of the image carrier rollers are integrally formed" is used herein in a comprehensive sense to broadly mean that the image carrier rollers are integrally formed together with the imaging sections (e.g., these components are formed as a unit detachable to the apparatus body).

In the image forming apparatus in one embodiment, a plurality of the pairs of transfer rollers are juxtaposed along the annular conveying path in a predetermined order that the intrinsic color images should be transferred onto the sheet, and wherein after introducing the sheet to a certain spot of the annular conveying path, the control section operates the pairs of transfer rollers, which are passed by the sheet till the sheet reaches a pair of transfer rollers of an intrinsic color which should be transferred first, only for conveyance.

The phrase "operated only for conveyance" is used herein to mean that the pairs of transfer rollers, which are passed by the sheet, do not perform image transfer but perform conveyance of the toner only.

In the image forming apparatus in this one embodiment, the intrinsic color images are transferred onto the sheet in a predetermined order. For example, the images are transferred in the order of yellow, cyan, magenta and black. Therefore, sufficient image quality is achieved.

In the image forming apparatus in one embodiment, a plurality of the pairs of transfer rollers are juxtaposed along the annular conveying path in a predetermined order that the intrinsic color images should be transferred onto the sheet, and wherein after the sheet passes a pair of the transfer rollers of an intrinsic color which should be transferred at last, the control section operates the pairs of transfer rollers, which are passed by the sheet till the sheet reaches a spot of the annular conveying path where the sheet should be released, only for conveyance.

In the image forming apparatus in this one embodiment, after the intrinsic color images are transferred onto the sheet in accordance with the predetermined order, additional images of unnecessary colors are not transferred. Therefore, sufficient image quality is achieved.

In the image forming apparatus in one embodiment, a plurality of the pairs of transfer rollers include a pair of black transfer rollers which should form an image of black as the intrinsic color image, wherein the image forming apparatus further comprises: a sheet introducing path which is connected to a spot between the pair of black transfer rollers and a pair of transfer rollers adjacent to an upstream side of the pair of black transfer rollers in the annular conveying path so as to introduce a sheet to the annular conveying path; and a sheet release path which is connected to a spot between the pair of black transfer rollers and a pair of transfer rollers adjacent to a downstream side of the pair of black transfer rollers in the annular conveying path so as to release a sheet from the annular conveying path, and wherein a path for the sheet to be conveyed at a time of monochrome image formation is a path which passes only the pair of black transfer rollers among a plurality of the pairs of transfer rollers.

In the image forming apparatus in this one embodiment, a path for the sheets to be conveyed at the time of monochrome image formation is a path which passes only the pair of black transfer rollers among a plurality of the pairs of transfer rollers, so that output of the sheet (the first sheet in the case of the printing job of a plurality of pages) becomes fast. Since images of colors other than black color are not transferred onto the sheet, resources are not wasted and energy saving becomes possible.

In the image forming apparatus in one embodiment, the path for the sheet to be conveyed at a time of monochrome image formation includes the sheet introducing path and the sheet release path and is circumscribed to a spot where the pair of black transfer rollers is placed in the annular conveying paths.

In the image forming apparatus in this one embodiment, the conveyance path of the sheets during monochrome image formation becomes substantially the shortest. Therefore, output of the sheet (the first sheet in the case of the printing job of a plurality of pages) becomes fast.

In the image forming apparatus in one embodiment, a manual paper feed opening placed above the annular conveying path, the manual paper feed opening being connected to the annular conveying path via a sheet introducing path.

In the image forming apparatus in this one embodiment, the sheet is fed from the manual paper feed opening through the sheet introducing path with use of gravity. Therefore, manual feeding of the sheet is performed smoothly.

In the image forming apparatus in one embodiment, an automatic feed opening placed in a lower level of the annular conveying path for automatic feeding of sheets, the automatic feed opening being connected to the annular conveying path via a sheet introducing path.

In the image forming apparatus in this one embodiment, the sheets are automatically fed from the automatic feed opening through the sheet introducing path. Therefore, automatic feeding of the sheets is performed smoothly. Moreover, the outlet of the sheets is easily placed in the upper part of the main body of the image forming apparatus. With this outlet, the user can easily take out the sheets after image formation.

Although the present invention has been described in detail, it is apparent that numerous modifications may be made. It should be understood that unless departing from the spirit and scope of the invention, such modifications that will be apparent to those skilled in the art are intended to be embraced in the scope of the appended claims.

REFERENCE SIGNS LIST

100, 200, 300, 400: Image forming apparatus

101, 201, 301, and 401: Main body casing

Y, M, C, K: Image forming unit 104Y, 104M, 104C, 104K, 204Y, 204M, 204C, 204K, 304Y, 304M, 304C, 304K, 404Y, 404M, 404C, 404K: Photoconductor drum

105Y, 105M, 105C, 105K, 205Y, 205M, 205C, 205K, 305Y, 305M, 305C, 305K, 405Y, 405M, 405C, 405K: Transfer roller

106, 206, 306, 406: Fixing unit

110Y, 110M, 110C, 110K, 210Y, 210M, 210C, 210K, 310Y, 310M, 310C, 310K, 410Y, 410M, 410C, 410K: Imaging section

CITATION LIST

Patent Literature

Patent Literature 1: JP H9-15916 A

Patent Literature 2: JP 2006-349701 A

The invention claimed is:

1. An image forming apparatus, comprising:

an annular conveying path which is curved to have an annular shape;

a plurality of image carrier rollers placed on an inner circumferential side of the annular conveying path so as to face the annular conveying path and so as to be juxtaposed in a sheet conveying direction along the annular conveying path;

opposed rollers provided on an outer circumferential side of the annular conveying path so as to be in pressure contact with each of the image carrier rollers to constitute pairs of transfer rollers together with each of the image carrier rollers;

imaging sections for forming intrinsic color images on surfaces of the respective image carrier rollers; and a control section for controlling so that a sheet is introduced to the annular conveying path and is passed sequentially through nip sections of the pairs of transfer rollers so as to be conveyed along the sheet conveying direction, while images, which are formed on surfaces of the respective image carrier rollers by the imaging sections, are transferred one by one onto the sheet, and the sheet with the images transferred thereon are released from the annular conveying path.

2. The image forming apparatus as claimed in claim 1, wherein the image carrier roller is constituted of a photoconductor drum, wherein the imaging section comprises at least: a charging section for uniformly charging the surface of each of the photoconductor drums; an exposure section for forming a latent image on the surface of each of the photoconductor drums; and a developing section for developing the latent image on the surface of each of the photoconductor drums to form a toner image, and wherein the image forming apparatus further comprises a fixing section for fixing the toner image on the sheet, which has been released from the annular conveying path, onto the sheet.

3. The image forming apparatus as claimed in claim 1, wherein a plurality of the image carrier rollers are integrally formed.

4. The image forming apparatus as claimed in claim 1, wherein a plurality of the pairs of transfer rollers are juxtaposed along the annular conveying path in a predetermined order that the intrinsic color images should be transferred onto the sheet, and wherein after introducing the sheet to a certain spot of the annular conveying path, the control section operates the pairs of transfer rollers, which are passed by the sheet till the sheet reaches a pair of transfer rollers of an intrinsic color which should be transferred first, only for conveyance.

5. The image forming apparatus as claimed in claim 1, wherein a plurality of the pairs of transfer rollers are juxtaposed along the annular conveying path in a predetermined order that the intrinsic color images should be transferred onto the sheet, and wherein after the sheet passes a pair of the transfer rollers of an intrinsic color which should be transferred at last, the control section operates the pairs of transfer rollers, which are passed by the sheet till the sheet reaches a spot of the annular conveying path where the sheet should be released, only for conveyance.

6. The image forming apparatus as claimed in claim 1, wherein a plurality of the pairs of transfer rollers include a pair of black transfer rollers which should form an image of black as the intrinsic color image, wherein the image forming apparatus further comprises: a sheet introducing path which is connected to a spot between the pair of black transfer rollers and a pair of transfer rollers adjacent to an upstream side of the pair of black transfer rollers in the annular conveying path so as to introduce a sheet to the annular conveying path; and a sheet release path which is connected to a spot between the pair of black transfer rollers and a pair of transfer rollers adjacent to a downstream side of the pair of black transfer rollers in the annular conveying path so as to release a sheet from the annular conveying path, and wherein a path for the sheet to be conveyed at a time of monochrome image formation is a path which passes only the pair of black transfer rollers among a plurality of the pairs of transfer rollers.

7. The image forming apparatus as claimed in claim 6, wherein the path for the sheet to be conveyed at a time of monochrome image formation includes the sheet introducing path and the sheet release path and is circumscribed to a spot where the pair of black transfer rollers is placed in the annular conveying paths.

8. The image forming apparatus as claimed in claim 1, comprising a manual paper feed opening placed above the annular conveying path, the manual paper feed opening being connected to the annular conveying path via a sheet introducing path.

9. The image forming apparatus as claimed in claim 1, comprising an automatic feed opening placed in a lower level of the annular conveying path for automatic feeding of sheets, the automatic feed opening being connected to the annular conveying path via a sheet introducing path.

* * * * *